US006017170A

United States Patent [19]

Michalo

[11] Patent Number: 6,017,170

[45] Date of Patent: Jan. 25, 2000

[54] ADJUSTABLE SELF LOCKING SHORING STRUT

[75] Inventor: Richard Scott Michalo, Kettering, Ohio

[73] Assignee: American Rescue Technologies, Inc., Kettering, Ohio

[21] Appl. No.: 09/088,342

[22] Filed: Jun. 1, 1998

[51] Int. Cl.[7] ..... E02D 5/00; E02D 17/04

[52] U.S. Cl. ..... 405/272; 60/547.1; 60/583; 405/282

[58] Field of Search ..... 405/281–283, 405/273, 303; 60/583, 547.1

[56] References Cited

U.S. PATENT DOCUMENTS

| | | | |
|---|---|---|---|
| Re. 30,185 | 1/1980 | Griswold | 405/272 |
| 3,598,207 | 8/1971 | Hartel | 188/289 |
| 3,791,151 | 2/1974 | Plank | 405/282 |
| 3,851,856 | 12/1974 | Berg | 405/282 X |
| 3,902,326 | 9/1975 | Langenbach, Jr. | 405/230 |
| 4,268,926 | 5/1981 | Roxton | 7/143 |
| 4,508,201 | 4/1985 | Axthammer et al. | 188/322 |
| 4,531,611 | 7/1985 | Curiel | 182/44 |
| 4,577,840 | 3/1986 | Meller et al. | 267/64.17 |
| 4,682,914 | 7/1987 | Aihara et al. | 405/283 |
| 4,685,253 | 8/1987 | Bitterly | 52/2 A |
| 4,750,568 | 6/1988 | Roxton | 173/121 |
| 4,787,781 | 11/1988 | Bradberry | 405/282 |
| 4,919,441 | 4/1990 | Marier et al. | 280/21.1 |
| 5,113,710 | 5/1992 | Wolfbauer, III | 73/862.54 |
| 5,127,634 | 7/1992 | Le Gourveller | 267/64.26 |
| 5,222,759 | 6/1993 | Wanner et al. | 280/697 |
| 5,232,312 | 8/1993 | Jennings et al. | 405/282 |
| 5,472,071 | 12/1995 | Zimmermann | 188/322.11 |
| 5,499,890 | 3/1996 | Kishi | 405/282 |
| 5,547,211 | 8/1996 | Runkel | 280/708 |
| 5,560,581 | 10/1996 | Cassone | 248/516 |
| 5,579,875 | 12/1996 | Vargas | 188/300 |
| 5,613,580 | 3/1997 | Young | 188/300 |
| 5,624,105 | 4/1997 | Runkel | 267/64.15 |
| 5,650,230 | 7/1997 | Huang et al. | 428/372 |

FOREIGN PATENT DOCUMENTS

| | | | |
|---|---|---|---|
| 958589 | 9/1949 | France | 60/583 |
| 2287605 | 5/1976 | France | 60/547.1 |
| 218965 | 1/1942 | Switzerland | 60/583 |
| 1528570 | 10/1978 | United Kingdom | 60/547.1 |

OTHER PUBLICATIONS

O'Connell, "Collapse Search and Rescue Operations: Tactics and Procedures," Fire Engineering, Mar. 1994.

*Primary Examiner*—Dennis L. Taylor
*Attorney, Agent, or Firm*—Thompson Hine & Flory LLP

[57] ABSTRACT

A pneumatic/hydraulic shoring strut is disclosed for bracing walls in various situations. The shoring strut is provided with features that allow it to be infinitely adjustable and self-locking. In a preferred embodiment, the strut contains an internal biasing member that urges contraction when pneumatic pressure is released. More particularly, the pneumatic/hydraulic shoring strut of the present invention is composed of an inner and outer cylinder which form an annular recess therebetween. The cylinders are mounted in first and second caps and an annular drive piston is positioned within the annular recess, creating first and second chambers. A port for injecting air into the first chamber is mounted on the outer cylinder and hydraulic fluid is sealed in the second chamber. A channel is provided in one of the caps providing fluid communication between the second chamber and an interior cavity located within the inner cylinder where a working piston is reciprocatingly mounted. The channel has a unidirectional flow control valve and a releasable flow restriction control mounted therein thereby facilitating the self-locking feature of the strut.

24 Claims, 3 Drawing Sheets

ADJUSTABLE SELF LOCKING SHORING STRUT

BACKGROUND OF THE INVENTION

This invention relates to shoring devices of the type used for stabilizing collapsed structures such as trenches or buildings. Particularly, these shoring devices are useful in rescue and safety applications for stabilizing a collapsed or unstable structure in order to safely and quickly allow rescue personnel, such as firemen, to reach and evacuate victims who may be injured or trapped inside. The shoring device of the present invention may also be used to maintain stability in the collapsed structure temporarily while the structure is repaired or reconstructed. Also, the shoring device disclosed herein may be used for stabilization of trenches that are dug for the laying of pipe, cable, etc. In particular, this invention is directed to an infinitely adjustable hydraulic/pneumatic self locking shoring strut for use in the above-mentioned applications.

Shoring devices for preventing the collapse of unstable structures to permit safe passage of rescue or construction personnel are well known. These struts have taken on many different designs and features over the years, utilizing various techniques to accomplish the goal of safer and easier to use equipment. One of these methods involves the use of a screw-type expander mechanism, the operation of which is well-known in the art. U.S. Pat. No. 3,393,521 discloses a shoring strut of this type wherein an externally threaded shaft is disposed in a housing within a threaded collar and has a load bearing surface on the distal end. In order to operate the strut, the collar is rotated with respect to the shaft forcing the shaft outward from the housing.

The struts of the type disclosed in U.S. Pat. No. 3,393,521 are not without problems. First, if pressure is being applied to the distal end of the strut, rotational force proportional to the pressure exerted on the end of the strut is required to extend the strut. Thus, if the screw type strut is extended by human power, there are situations where the strut could not be extended to the required length due to the incapability of the human operator to generate enough torque to extend the strut. Another problem arises in that although the friction between the threads on the strut and the threads on the collar is sufficient to prevent the strut from retracting due to the pressure on the distal end to some extent, generally a mechanical stop, such as a pin or a detent mechanism, is required to insure that the strut does not self retract, thereby threatening the safety of the operators. Two features that are generally considered highly desirable in a shoring strut, namely a self locking characteristic and infinite adjustability, have not yet been simply and reliably achieved with the use of mechanical stop mechanisms. Furthermore, in the case of pin type stops, the operator is required to perform the delicate and potentially dangerous task of aligning the holes for insertion of the pin while simultaneously maintaining the position of the strut. A self locking feature is desirable because the strut can be lowered into the required location and extended remotely without the operator having to enter the unsafe area. While struts utilizing a detent mechanism can be self locking, thereby avoiding some of the problems associated with pin type stops, they also generally are not infinitely adjustable. Furthermore, the reliability of these detent type stops can be questionable, being prone to slippage or failure thereby jeopardizing the safety of the operator.

Struts have been developed that utilize hydraulic forces to extend the strut. U.S. Pat. No. 3,404,533 discloses a shoring strut of this type which utilizes a linkage arrangement coupling hydraulic devices to a pair of vertical shoring members in a pivotal manner. A locking means is also provided to lock the strut in place once it is properly situated. U.S. Pat. No. 4,682,914 discloses a similar strut of this type comprising a piston disposed within a cylinder which is hydraulically operated and which has a spring biasing means to contract the strut in the absence of hydraulic pressure. However, the locking force of the '914 patent is provided by the continued application of the hydraulic pressure, and has no independent locking means. U.S. Pat. No. 4,787,781 discloses a trench shoring device utilizing a hydraulic piston and a locking device. The piston is threaded and a nut is provided which can be rotated down the piston shaft after the strut is extended to engage the outer piston cylinder, thereby preventing piston contraction. U.S. Pat. No. 5,499,890 discloses a trench shoring device with a locking mechanism which uses a piston in a cylinder that is reciprocated hydraulically. The locking mechanism consists of a pair of cam lobes which are rotated towards the piston thereby grabbing and locking said piston in place when corresponding hydraulic securing pins are activated.

While the use of hydraulically actuated pistons and mechanical locking systems as described above is responsive to some problems found in prior shoring struts, several other areas needed to be addressed. First, while the use of hydraulic based systems is preferred over rotational screw-type struts, the hydraulic pumps required to expand struts under heavy loads need to be quite large and powerful. Therefore, they tend to be complicated and expensive. Furthermore, especially in rescue situations, many struts may be required to stabilize the collapsed structure. Therefore, in an all hydraulic system, a large reservoir is necessary to insure that there is enough hydraulic fluid available to adequately expand all of the required struts. Furthermore, when the struts are retracted, the same fluid capacity is necessary to receive the fluid from the struts. Also, the hoses and connections required for these hydraulic systems can be difficult to handle. As can easily be imagined, a system such as this is not only large and cumbersome, but it can become quite messy, especially when leaks begin to develop in the system.

Pneumatic systems have many advantages over hydraulic systems. While reliable heavy duty pneumatic compressors can be obtained relatively inexpensively, pneumatic systems can also be actuated by compressed air that is fed from bottles or tanks. This feature is particularly useful in rescue situations where a reliable power source may be unavailable or the operating space may be strictly confined or not easily accessible. In such cases, rescue personnel may use air from readily available breathing bottles in order to expand the struts, increasing the speed with which they may reach endangered victims. Obviously, time is critical in these potential life and death situations, and any time savings that may be obtained are highly desirable. Also, as mentioned above, the mess and complications found in hydraulic set-ups are not found in similar capacity pneumatic systems. However, all pneumatic systems have a few inherent problems. The application of high pressure air has been known to drive the piston completely out of the strut. Furthermore, the advantages of a hydraulic system, particularly the superior damping qualities, are not present in an all pneumatic system.

Thus, there is a need for an infinitely adjustable self locking shoring strut which utilizes the advantages of both pneumatic and hydraulic systems, is of relatively simple construction, is safe and reliable, and is inexpensive to fabricate.

SUMMARY OF THE INVENTION

In accordance with the present invention, an adjustable self locking shoring strut is provided that utilizes hydraulic and pneumatic features. It is an object of the present invention to provide a shoring strut of simple design which is easy to use and is reliable.

More particularly, a shoring strut is provided having a first cap and a second cap attached to an outer cylinder with an annular inner pneumatic/hydraulic piston and a hydraulic working piston disposed within. The shoring strut includes an air inlet allowing pneumatic flow to one side of the pneumatic/hydraulic annular drive piston and hydraulic liquid is provided on the other side of the piston. A channel connects the hydraulic side of the pneumatic/hydraulic piston to an interior cavity where the hydraulic working piston is located. A unidirectional flow control valve is disposed in the channel to prevent liquid from flowing backwards, thereby automatically preventing the working piston from contracting. A release control is also provided which may be activated to allow liquid flow backwards, thus allowing contraction of the working piston as desired. In a preferred embodiment, a biasing means such as a spring, is provided to facilitate contraction of the working piston.

Other embodiments, such as one utilizing a single cylinder having the drive piston and the working piston coaxially aligned within, are also possible and considered within the scope of the present invention. In this embodiment two chambers for hydraulic fluid are located between the drive piston and the working piston, and a fluid channel is provided between the two chambers. The unidirectional flow control valve and the releasable flow restriction control are then located in this channel to provide the self locking feature for the strut. This embodiment, however, does not provide the space saving advantages of a reverse acting embodiment as described above.

It is also possible to eliminate the drive piston in these embodiments, replacing it with an expandable bladder. The inlet port for the fluid is then directed into the bladder such that when fluid is injected, the bladder expands thereby forcing the hydraulic fluid against the working piston. Also, while air is preferred as the injection fluid for moving the drive piston, other gases are also acceptable. Even a liquid, particularly one that may be cheaply and easily obtained such as water, may be used.

DETAILED DESCRIPTION

Figure 1:
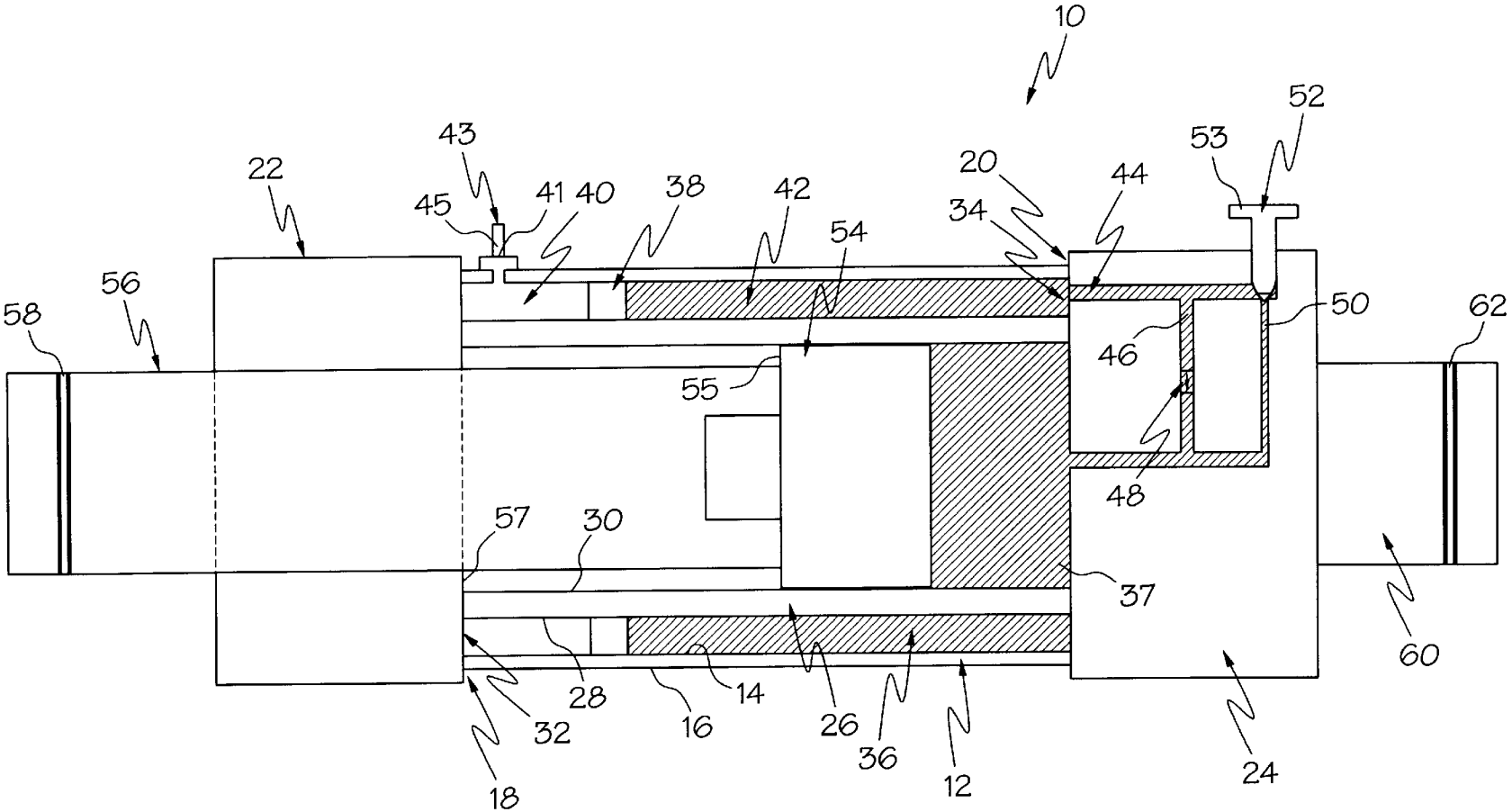
FIG. 1 is a schematic side elevational view of a self locking shoring strut of the present invention.

Referring to FIG. 1, a pneumatic/hydraulic shoring strut generally designated 10 is shown in accordance with a preferred embodiment of the present invention. An outer cylinder 12 with an inner wall 14, an outer wall 16, a first end 18, and a second end 20 is provided. A first cap 22 is positioned on the first end 18, and a second cap 24 is positioned on the second end 20. The first cap 22 and second cap 24 have been machined with an annular groove (not shown) having an inner diameter slightly less than the inner diameter of the outer cylinder 12, and an outer diameter slightly greater than the outer diameter of the outer cylinder 12. Thus, the first end 18 of the outer cylinder 12 can be fitted into the first cap 22 and the second end 20 of the outer cylinder 12 can be fitted into the second cap 24 in a gas/liquid tight relationship. In a similar fashion an inner cylinder 26 is provided having an outer wall 28, an inner wall 30, a first end 32, and a second end 34. The outer diameter 28 of the inner cylinder 26 is smaller than the inner diameter 14 of the outer cylinder 12, such that an annular recess 36 is formed between the inner and outer cylinders when the second end 34 of the inner cylinder 26 is placed in an annular groove (not shown) in the second cap 24 and the first end 32 is placed in a corresponding annular groove (not shown) in the first cap 22. In addition to the annular recess 36 formed between the inner and outer cylinders, a cylindrical interior cavity 37 is formed within the inner cylinder 26.

An annular drive piston 38 is provided and is mounted for reciprocation encircling the inner cylinder 26 within the annular recess 36, thereby dividing the annular recess 36 into a first chamber 40 proximate the first cap 22, and a second chamber 42 proximate the second cap 24. An inlet 43 having a nipple 45 provides an entry way into the first chamber 40 of the annular recess for pneumatic flow from a pneumatic source such as a breather bottle or a compressor (not shown). A filter 41 is mounted over the inlet to prevent dirt and particulate matter from entering the first chamber 40 and fouling the piston 38. Hydraulic liquid is located in the second chamber 42 of annular recess 36. The piston 38 includes seals (not shown) to maintain a gas/liquid tight relationship between the two chambers of the annular recess 36. The second cap 24 contains a channel 44 that provides liquid communication between the second chamber 42 of the annular recess 36 and the interior cavity 37 of the inner cylinder 26. The channel 44 includes an extending branch 46 which has a unidirectional flow control valve 48 positioned within, and a contracting branch 50, which is obstructed by a releasable flow restriction control 52.

A working piston 54 is placed for reciprocation within the interior cavity 37 and has a piston rod 56, which extends through the first cap 22, attached thereto. The working piston 54 is equipped with seals (not shown) to maintain a gas/liquid tight relationship between the interior cavity 37 and the atmosphere. The working piston 54 has a larger diameter than the piston rod 56 thus creating a ledge 55 which engages an end 57 of the first cap 22, thereby preventing overextension of the piston rod 56. The end 58 of the piston rod 56 which protrudes through the first cap 22 is adapted to receive a removable attachment (not shown) such as a rubber cap or cleated member for gripping the surface against which the shoring strut is braced. Similarly, the second cap 24 includes a protrusion 60 having an end 62 adapted to receive a removable attachment (not shown). Several types of suitable attachments are available commercially, having various designs for use in many different situations. For example, a rigid base design having non-skid grooves is appropriate for use on solid surfaces. A swivel base design has a square base that can swivel in any direction, thereby allowing bracing of items surfaces that are not in direct alignment. A base having a conical shape that may be used for holding a strut at an angle against smooth surfaces, such as the sheet metal of a car, is also available, as well as many other specialized designs.

Figure 2:
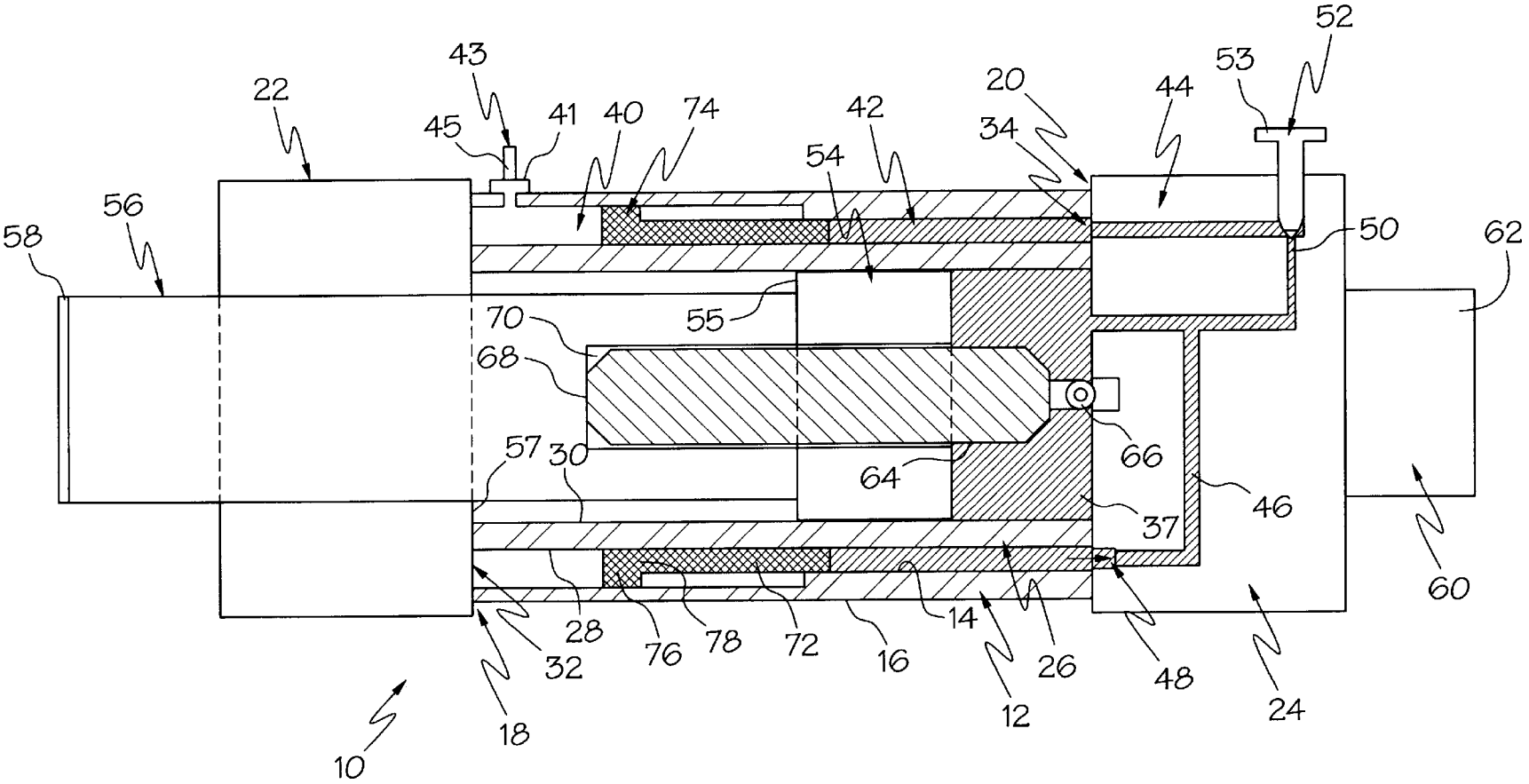
FIG. 2 is a schematic side elevational view of an alternate embodiment of the self locking shoring strut of FIG. 1 having a spring biasing means to facilitate contraction of the working piston.

As shown in FIG. 2, in a preferred embodiment of the shoring strut 10, a spring biasing member 64 is included in order to contract the piston rod 56 when pressure from the pneumatic compressor (not shown) is disengaged and the flow restriction control 52 is released, thereby allowing hydraulic liquid flow backwards through the contracting branch 48 of the channel 44. The spring biasing member 64 is placed in the interior cavity 37 and has a point of attachment 66 on the second cap 24 and another point of attachment 68 in the piston rod 56. In this embodiment, the working piston 54 and piston rod 56 include an internal bore 70 to receive the spring biasing member 64. In a further embodiment of the present invention as shown in FIG. 2, a first end 72 of the annular drive piston 74 is formed having a smaller outer diameter than the rest of the annular drive piston 74, thereby creating an annular flange 76 on the second end 78 of the annular drive piston 74. The larger surface area of the flange 76 creates pressure amplification at the first end 72 of the annular drive piston 74. Thus, a smaller input pressure from the pneumatic source is required to achieve the necessary output pressure for the strut 10.

Figure 3:
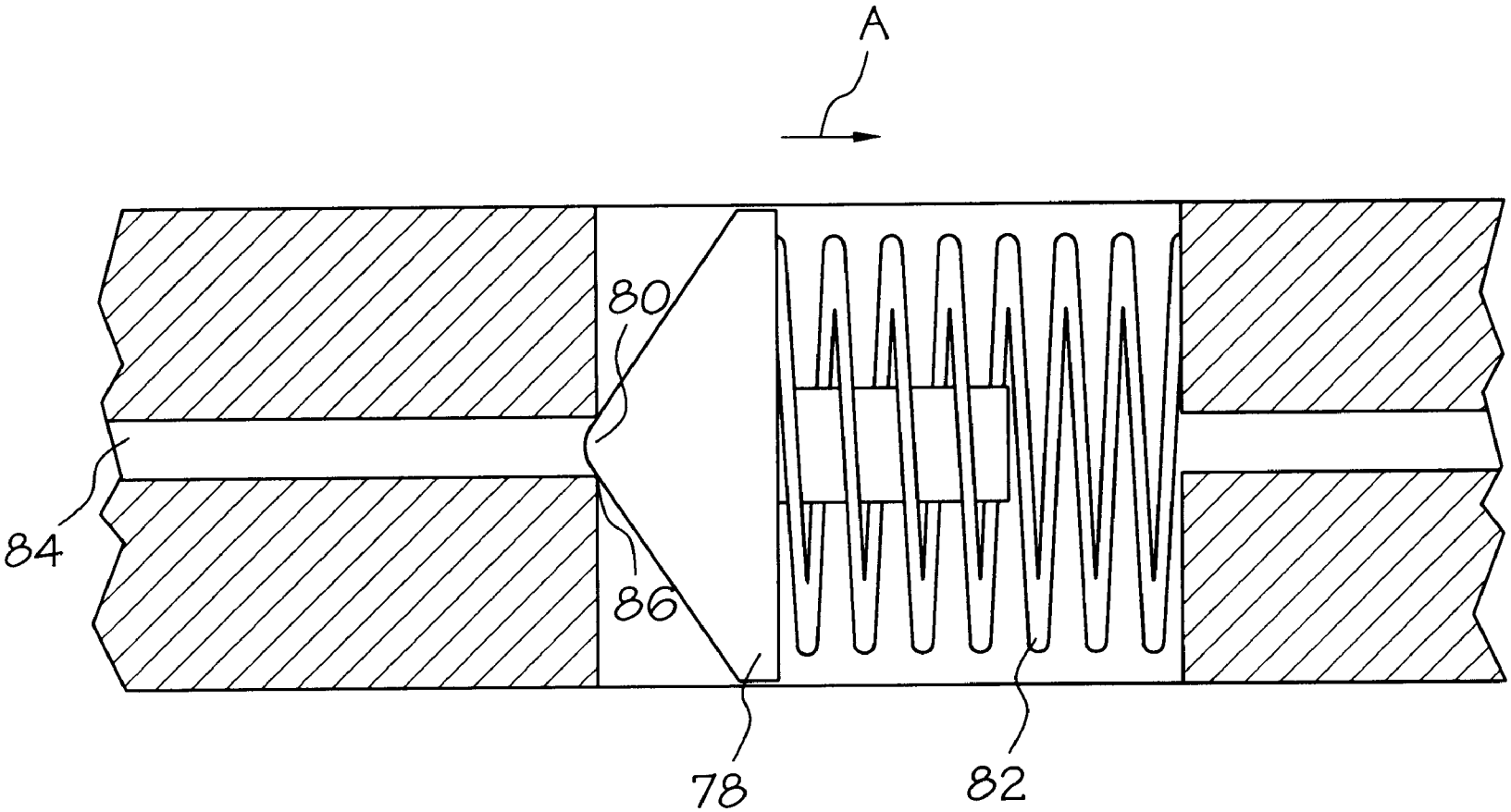
FIG. 3 is a schematic overhead view of the unidirectional flow control valve of the self locking shoring strut of FIGS. I and 2.

As shown in FIG. 3 , the unidirectional flow control valve 48 of the present invention preferably consists of a plunger 78 having a conically shaped nose 80 which is biased by a spring 82. The plunger 78 is mounted in the fluid path 84 so that absent fluid flow in a forward direction A, the nose 80 of the plunger 78 is biased to engage the mouth 86 of the fluid path 84, thereby preventing fluid flow in a reverse direction. When fluid flows in a forward direction, the nose 80 of the plunger 78 is engaged by the fluid and displaced against the biasing force of the spring 82, thereby allowing fluid passage.

The operation of the shoring strut 10 of the present invention is as follows. A hose from a pneumatic source, preferably a compressed air tank, such as a breathing bottle (not shown), is attached to the nipple 45 for the air inlet 43. The ends 58, 62 of the piston rod 56 and the protrusion 62 are fitted with appropriate attachments, the shoring strut 10 is positioned in the area in need of support, and the pneumatic source is activated. Flow from the pneumatic source enters the first chamber 40 of the annular recess 36, thereby forcing the annular drive piston 38 towards the second cap 24. The expansion of the annular drive piston 38 forces the hydraulic liquid in the second chamber 42 of the annular recess 36 through the extending branch 46 of the liquid flow path 44. The hydraulic liquid then flows through the unidirectional flow control valve 48 and into the interior cavity 37, forcing the working piston 54 towards the first cap 22. The piston rod 56 is thus pushed outward of the first cap 22, thereby extending the strut 10 against the area in need of support.

The self-locking feature of the shoring strut 10 is enabled by the operation of the unidirectional flow control valve 48 in combination with the releasble flow restriction control valve 52. The unidirectional valve 48 only allows liquid flow forward through the extending branch 46 of the channel 44 into the interior cavity 37 and the flow restriction control valve 52 only allows liquid flow backward through the contracting branch 50 of the channel 44 into the second chamber 42 of the annular recess 36 when manually released by an operator. Thus, after the hydraulic liquid is forced into the interior cavity 37 thereby extending the shoring strut 10, contraction of the strut is prevented by the force of the hydraulic liquid. In order to contract the strut, the releasable flow restriction control 52 must be disengaged, thereby allowing hydraulic liquid flow through the contracting branch 50 of the channel 44 back into the second chamber 42 of the annular recess 36. In a preferred embodiment, the flow restriction control 52 is a threaded pin and contraction of the strut may be accomplished in a slow, controlled manner. This is done by releasing the control incrementally so that the contracting branch 50 of the channel 44 remains partially restricted. Preferably the flow restriction control device 52 has a head 53 that is eccentrically shaped to mate with a telescoping releasing tool (not shown) so that the restriction control device 52 may be operated from a remote location. In a preferred embodiment, as shown in FIG. 2, the operation of the spring biasing member 64 provides a force which contracts the strut 10 when the releasable flow restriction control 52 is disengaged, thereby allowing the strut 10 to contract and be easily removed.

In another embodiment of the invention, the annular drive piston 38 is removed and an expandable bladder (not shown) is fitted in the annular recess 36. The inlet 43 is then attached to the interior of the bladder, such that when compressed air is introduced through the inlet 43, the bladder expands thereby forcing the hydraulic fluid through the fluid channel 44 and expanding the strut 10. In yet a further embodiment, the compressed air is replaced with another hydraulic fluid, preferably water, and the strut is expanded through the introduction of water through the inlet 43.

While the form of the apparatus herein described constitutes a preferred embodiment of the invention, it is to be understood that the invention is not limited to this precise form of apparatus, and that changes may be made therein without departing from the scope of the invention.

What is claimed is:

1. A shoring strut comprising:

a cylinder;

a drive piston and a working piston recprocatingly mounted in said cylinder;

a first chamber in said cylinder for receiving a first fluid, said first chamber being in fluid communication with a first side of said drive piston;

a second chamber in said cylinder containing a hydraulic fluid, said second chamber being in fluid communication with a second side of said drive piston and a first side of said working piston;

a port for injecting said first fluid into said first chamber;

wherein when said first fluid is injected through said port into said first chamber, pressure is applied to said first side of said drive piston and said drive piston is urged in a first direction, thus urging hydraulic liquid from said second chamber against said first side of said working piston, thereby actuating said shoring strut.

2. The shoring strut of claim 1 containing a third chamber between said second chamber and said working piston including a fluid channel between said second and third chambers, said fluid channel containing a unidirectional flow control valve to allow fluid flow from said second chamber to said third chamber in a forward direction, and a releasable restriction control to regulate fluid flow back from said third chamber to said second chamber.

3. The shoring strut of claim 2 wherein said first fluid is a gas.

4. The shoring strut of claim 3 wherein said first fluid is a liquid.

an expandable bladder mounted within said recess;

a channel providing fluid communication between said second chamber of said annular recess and said interior cavity of said inner cylinder;

a hydraulic fluid in said second chamber of said recess and said interior cavity;

a port for injecting a fluid into said bladder;

wherein when fluid is injected through said port into said bladder, the bladder expands, thus expelling hydraulic liquid from said recess into said interior cavity, thereby actuating said drive piston.

5. A shoring strut comprising:

an outer cylinder and an inner cylinder, said inner cylinder being coaxially aligned within said outer cylinder and said inner cylinder having an outer diameter less than an inner diameter of said outer cylinder thereby forming an annular recess therebetween, said inner cylinder further having an interior cavity;

an annular drive piston reciprocatingly mounted in said annular recess, said recess being divided into a first chamber and a second chamber by said annular drive piston;

a working piston having an axially aligned piston rod extending therefrom, said working piston being reciprocatingly mounted in said interior cavity of said inner cylinder;

a channel providing fluid communication between said second chamber of said annular recess and said interior cavity of said inner cylinder;

a hydraulic fluid in said second chamber of said recess and said interior cavity;

a port for injecting a first fluid into said first chamber of said recess;

wherein said first fluid is injected through said port into said first chamber, pressure is applied to one side of said annular drive piston and said annular drive piston is urged in a first direction, thus expelling hydraulic liquid from said second chamber of said recess into said interior cavity, thereby actuating said working piston.

6. The shoring strut of claim 5 wherein said channel includes a unidirectional flow control valve to allow hydraulic fluid to flow from said second chamber of said recess to said interior cavity in one direction, and a releasable flow restriction control to regulate the flow of hydraulic fluid back from said interior cavity to said second chamber.

7. The shoring strut of claim 6 including a first cap and a second cap which fixedly receive ends of said cylinders.

8. The shoring strut of claim 7 wherein said channel is located in one of said caps.

9. The shoring strut of claim 8 wherein said channel includes an extending branch wherein said unidirectional flow control valve is mounted and a contracting branch wherein said releasable flow restriction control is mounted.

10. The shoring strut of claim 9 wherein said extending branch and said contracting branch are connected to said channel in parallel.

11. The shoring strut of claim 10 wherein said releasable flow restriction control is movable from an open position allowing hydraulic fluid flow, to a closed position blocking hydraulic fluid flow.

12. The shoring strut of claim 11 wherein said releasable flow restriction control contains a biasing member, which biases said control to a closed position absent an intervening force.

13. The shoring strut of claim 5 wherein said working piston is spring biased to contract when liquid pressure is released.

14. The shoring strut of claim 5 wherein said annular drive piston has a flange on one end having a larger outer diameter than said annular drive piston.

15. The shoring strut of claim 14 wherein said outer cylinder is shaped to reciprocatingly receive said flange.

16. The shoring strut of claim 7 wherein said working piston has a larger outer diameter than said piston rod creating a ledge that engages a stop thereby preventing overextension of said piston rod.

17. The shoring strut of claim 16 wherein said stop is an end of one of said caps.

18. The shoring strut of claim 7 wherein said first and second caps have annular grooves to fixedly receive ends of said inner and outer cylinders.

19. The shoring strut of claim 6 wherein said flow restriction control has an eccentrically shaped head for mating with a telescoping tool to facilitate remote operation of said flow restriction control.

20. The shoring strut of claim 6 wherein said flow restriction control is a threaded pin.

21. The shoring strut of claim 5 wherein said shoring strut may be extended from a remote location.

22. A shoring strut comprising:

an outer cylinder and an inner cylinder, said inner cylinder being coaxially aligned within said outer cylinder and said inner cylinder having an outer diameter less than an inner diameter of said outer cylinder thereby forming an annular recess therebetween, said inner cylinder further having an interior cavity;

a working piston recprocatingly mounted in said interior cavity of said inner cylinder;

an expandable bladder mounted in said annular recess;

a channel providing fluid communication between said recess and said interior cavity of said inner cylinder;

a hydraulic fluid in said recess and said interior cavity;

a port for injecting a first fluid into said bladder;

wherein when said first fluid is injected through said port into said bladder, hydraulic fluid in said recess is urged through said channel into said interior cavity, thereby actuating said working piston.

23. The shoring strut of claim 22 wherein said first fluid is a gas.

24. The shoring strut of claim 22 wherein said first fluid is a liquid.

* * * * *